US009256903B2

(12) United States Patent
Emura

(10) Patent No.: US 9,256,903 B2
(45) Date of Patent: Feb. 9, 2016

(54) SERVER SYSTEM, PRODUCT RECOMMENDATION METHOD, PRODUCT RECOMMENDATION PROGRAM AND RECORDING MEDIUM HAVING COMPUTER PROGRAM RECORDED THEREON

(75) Inventor: Sadaaki Emura, Shinagawa-ku (JP)

(73) Assignee: Rakuten, Inc., Tokyo (JP)

( * ) Notice: Subject to any disclaimer, the term of this patent is extended or adjusted under 35 U.S.C. 154(b) by 0 days.

(21) Appl. No.: 13/390,828

(22) PCT Filed: Nov. 5, 2010

(86) PCT No.: PCT/JP2010/069735

§ 371 (c)(1),
(2), (4) Date: Feb. 16, 2012

(87) PCT Pub. No.: WO2011/080966

PCT Pub. Date: Jul. 7, 2011

(65) Prior Publication Data

US 2012/0150891 A1 Jun. 14, 2012

(30) Foreign Application Priority Data

Dec. 29, 2009 (JP) ..... 2009-299009

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
None
See application file for complete search history.

(56) References Cited

U.S. PATENT DOCUMENTS 7,330,826 B1 * 2/2008 Porat et al. ..... 705/26.3
7,584,124 B2 * 9/2009 Porat et al. ..... 705/26.3

(Continued)

FOREIGN PATENT DOCUMENTS

JP 2002-041861 A 2/2002
JP 2003-242387 A 8/2003

(Continued)

OTHER PUBLICATIONS

International Search Report of PCT/JP2010/069735 dated Jan. 25, 2011.

(Continued)

*Primary Examiner* — Hung Le
(74) *Attorney, Agent, or Firm* — Sughrue Mion, PLLC

(57) ABSTRACT

A search is performed for information of other products associated with a question about a specific product.

A server system 10 searches for information of other products associated with a question about a specific product, in accordance with the following procedure. [1] The server system inputs a product ID and a question text (text) related to a question (S405). [2] The server system extracts a product name corresponding to the product ID from product basic information (FIG. 2(*b*-1)) in an auction DB 12 (S410). [3] The server system analyzes each of the product name and the question text to specify one or more keywords (S415). [4] The server system sets a search condition for a search for products associated with each specified keyword (S420) and extracts necessary items out of the product information satisfying the search condition, from the product basic information, display information, and product price information (FIGS. 2(*b*-1) to (*b*-3)) in the auction DB 12 (S425). [5] The server system outputs the extracted necessary items out of the product information (S430).

12 Claims, 14 Drawing Sheets

(56) References Cited

U.S. PATENT DOCUMENTS

| | | | | |
|---|---|---|---|---|
| 7,962,374 | B2 * | 6/2011 | Altschuler | G06Q 30/00 705/26.1 |
| 8,060,463 | B1 * | 11/2011 | Spiegel | G06Q 30/02 707/609 |
| 8,180,676 | B2 * | 5/2012 | Altberg et al. | 705/14.73 |
| 8,204,818 | B1 * | 6/2012 | Aggarwal | 705/37 |
| 8,438,072 | B2 * | 5/2013 | Fusz et al. | 705/26.3 |
| 8,484,084 | B2 * | 7/2013 | Altberg et al. | 705/14.71 |
| 2001/0029478 | A1 * | 10/2001 | Laster et al. | 705/37 |
| 2002/0069126 | A1 * | 6/2002 | Matsushima | 705/26 |
| 2002/0069134 | A1 * | 6/2002 | Solomon | G06Q 30/0611 705/80 |
| 2002/0082975 | A1 * | 6/2002 | Fujita et al. | 705/37 |
| 2002/0116305 | A1 * | 8/2002 | Abhyanker | 705/35 |
| 2002/0120556 | A1 * | 8/2002 | Saito | 705/37 |
| 2002/0143646 | A1 * | 10/2002 | Boyden et al. | 705/26 |
| 2004/0078214 | A1 * | 4/2004 | Speiser et al. | 705/1 |
| 2005/0004880 | A1 * | 1/2005 | Musgrove et al. | 705/400 |
| 2005/0182706 | A1 * | 8/2005 | Shimizu et al. | 705/37 |
| 2005/0234801 | A1 * | 10/2005 | Zhang et al. | 705/37 |
| 2005/0234803 | A1 * | 10/2005 | Zhang et al. | 705/37 |
| 2006/0004647 | A1 * | 1/2006 | Srinivasamurthy et al. | 705/37 |
| 2006/0085286 | A1 * | 4/2006 | Lutnick | G06Q 10/06 705/26.7 |
| 2007/0016493 | A1 | 1/2007 | Kelly et al. | |
| 2007/0055616 | A1 * | 3/2007 | Clay et al. | 705/37 |
| 2007/0160184 | A1 * | 7/2007 | Altberg et al. | 379/114.13 |
| 2007/0192126 | A1 * | 8/2007 | Ganesh | 705/1 |
| 2008/0071594 | A1 * | 3/2008 | Morin | 705/7 |
| 2008/0082633 | A1 * | 4/2008 | Koyama et al. | 709/219 |
| 2008/0189207 | A1 * | 8/2008 | Wurster | 705/40 |
| 2008/0208717 | A1 * | 8/2008 | Suleymanov | 705/27 |
| 2009/0119187 | A1 * | 5/2009 | Goino | 705/26 |
| 2010/0076857 | A1 * | 3/2010 | Deo | G06Q 30/00 705/26.1 |
| 2010/0107093 | A1 * | 4/2010 | Perkowski | 715/763 |
| 2010/0191714 | A1 * | 7/2010 | Wen et al. | 707/706 |
| 2010/0217680 | A1 * | 8/2010 | Fusz et al. | 705/26 |
| 2010/0257105 | A1 * | 10/2010 | Wurster | 705/80 |
| 2010/0262458 | A1 * | 10/2010 | Schwarz et al. | 705/10 |
| 2010/0262510 | A1 * | 10/2010 | Schwarz et al. | 705/26 |
| 2011/0125605 | A1 * | 5/2011 | Chatter et al. | 705/26.3 |
| 2011/0145051 | A1 * | 6/2011 | Paradise et al. | 705/14.25 |
| 2011/0153449 | A1 * | 6/2011 | Hite | 705/26.3 |
| 2011/0202424 | A1 * | 8/2011 | Chun et al. | 705/26.8 |
| 2011/0320364 | A1 * | 12/2011 | Van Horn et al. | 705/80 |
| 2012/0066243 | A1 * | 3/2012 | Jammalamadaka | 707/759 |
| 2012/0197749 | A1 * | 8/2012 | Gray | 705/26.3 |
| 2012/0290442 | A1 * | 11/2012 | Starr | G06Q 30/0603 705/26.63 |
| 2013/0013422 | A1 * | 1/2013 | Altberg et al. | 705/14.71 |

FOREIGN PATENT DOCUMENTS

| | | | |
|---|---|---|---|
| JP | 2006-031658 | A | 2/2006 |
| JP | 2008-139928 | A | 6/2008 |
| JP | 2009-193566 | A | 8/2009 |
| WO | 01/04723 | A2 | 1/2001 |

OTHER PUBLICATIONS

Rakuten Auction Inc., "User's Guide Buy Search", [online], Internet (URL:http://auction.rakuten.co.jp/guide/main/buy_search.html).

Rakuten Auction Inc., "User's Guide Sell Display to Bid", [online], (URL:http://auction.rakuten.co.jp/guide/main/sell_display.html).

International Preliminary Report on Patentability in International Application No. PCT/JP2010/069735 issued on Aug. 23, 2012.

Japanese Office Action issued on Feb. 5, 2013 in counterpart JP Application No. 2011-547391.

Japanese Office Action dated Feb. 5, 2013, issued in JP Patent Application No. 2011-547391.

* cited by examiner

Fig.2

(a)USER INFORMATION (USER DB)

| |
|---|
| USER ID |
| PASSWORD |
| MAIL ADDRESS |
| NICKNAME |
| ⋮ |

(b-1)PRODUCT BASIC INFORMATION (AUCTION DB)

| |
|---|
| PRODUCT ID |
| PRODUCT NAME |
| PRODUCT CATEGORY |
| PRODUCT DESCRIPTION |
| PRODUCT IMAGE URL |
| PRODUCT PAGE URL |
| ⋮ |

(b-2)PRODUCT INFORMATION (AUCTION DB)

| |
|---|
| DISPLAY ID |
| PRODUCT ID |
| USER ID(SELLING USER) |
| STARTING TIME |
| ENDING TIME |
| BID ID (SUCCESSFUL BID CANDIDATE) |
| STATUS |
| SUCCESSFUL BID DATE |
| ⋮ |

(b-3)PRODUCT PRICE INFORMATION (AUCTION DB)

| |
|---|
| DISPLAY ID |
| INITIAL PRICE |
| CURRENT PRICE |
| ⋮ |

(b-4)BID INFORMATION (AUCTION DB)

| |
|---|
| BID ID |
| DISPLAY ID |
| USER ID(BUYING USER) |
| BID PRICE |
| ⋮ |

(c-1)QUESTION INFORMATION (QUESTION DB)

| |
|---|
| QUESTION ID |
| USER ID(BUYING USER) |
| DISPLAY ID |
| QUESTION TEXT |
| ⋮ |

(c-2)ANSWER INFORMATION (QUESTION DB)

| |
|---|
| ANSWER ID |
| QUESTION ID |
| USER ID(BUYING USER) |
| DISPLAY ID |
| ANSWER TEXT |
| ⋮ |

*Fig.6*

600

610 info@auction.*******.co.jp

620

[••Auction] Question about product asked.

630

Mr. C

Here is a message from ••Auction.

631

There is a user asking a question about another product similar to the product displayed by Mr. C.

**********

632

■Product Name
"Product c"

■Status of Auction
in progress

■Product Page URL
http://auction.item.xxxxxxx.co.jp/a/xxxxxxx/xxxxxxxx

**********

633

You can make the above product appeal to the questioner by answering the question.

An answer must be given in view of the following notes.

(1) No answer should be made if you consider the above product does not suit the questioner.

(2) The content of your answer will be published along with the question on the product page.

(3) Your answer is valid only during the auction period. If you have any product not sold in a past auction, you can answer only after another auction of the product is started.

**********

634

■Click here to answer.
https://auction.xxxxxxx.co.jp/xxxxxxxx?gid=xxxxxxx

⋮

*Fig.10*

(a)USER INFORMATION (USER DB)

| |
|---|
| USER ID |
| PASSWORD |
| MAIL ADDRESS |
| NICKNAME |
| ⋮ |

(b)PRODUCT INFORMATION (PRODUCT DB)

| |
|---|
| PRODUCT ID |
| PRODUCT NAME |
| PRODUCT CATEGORY |
| PRODUCT DESCRIPTION |
| PRODUCT IMAGE URL |
| PRODUCT PAGE URL |
| USER ID(SELLING USER) |
| PRODUCT PRICE |
| ⋮ |

(c-1)QUESTION INFORMATION (QUESTION DB)

| |
|---|
| QUESTION ID |
| USER ID(BUYING USER) |
| PRODUCT ID |
| QUESTION TEXT |
| ⋮ |

(c-2)ANSWER INFORMATION (QUESTION DB)

| |
|---|
| ANSWER ID |
| QUESTION ID |
| USER ID(BUYING USER) |
| PRODUCT ID |
| ANSWER TEXT |
| ⋮ |

SERVER SYSTEM, PRODUCT RECOMMENDATION METHOD, PRODUCT RECOMMENDATION PROGRAM AND RECORDING MEDIUM HAVING COMPUTER PROGRAM RECORDED THEREON

CROSS REFERENCE TO RELATED APPLICATIONS

This application is a National Stage of International Application No. PCT/JP2010/069735 filed Nov. 5, 2010, claiming priority based on Japanese Patent Application No. 2009-299009 filed Dec. 29, 2009, the contents of all of which are incorporated herein by reference in their entirety.

TECHNICAL FIELD

The present invention relates to a scheme for providing specific information to user terminals and, more particularly, to a process to search for information of products associated with a posted question.

BACKGROUND ART

<Prior Art 1>

A product search function is provided in an Internet auction management service (e.g., cf. Non Patent Literature 1).

For example, if a desired product is decided, a user can conduct a search using a product name or the like as a keyword (cf. "Search" in the same literature). Furthermore, the user can add another keyword or select a product category to narrow down desired products (cf. "Narrow" in the same literature).

<Prior Art 2>

A function to ask a question to a seller about a specific product is provided in an Internet auction management service (e.g., cf. Non Patent Literatures 1 and 2).

For example, a user considering making a bid for a specific product is allowed to ask a question to a seller through a question entry page for the product (cf. "Ask a question to the seller" in Non Patent Literature 1). When the seller gives an answer to the question, the question and answer are published on a product page (cf. "What will happen with your question about the product" in Non Patent Literature 2).

FIG. 14 shows a display example of the question entry page.

A user considering making a bid for a specific product is allowed not only to ask a question, but also to make a demand (request) about a product to a seller through the entry page for the product. In this manner, a user desiring to purchase a product from an online shop using the Internet such as Internet auction and electronic mall makes an inquiry to a seller by entering a text such as a question, a demand, or a desire about a specific product.

CITATION LIST

Non Patent Literatures

Non Patent Literature 1: Rakuten Auction, Inc., "User's guide Buy Search," [online], Internet <URL:http://auction-.rakuten.co.jp/guide/main/buy_search.html>

Non Patent Literature 2: Rakuten Auction, Inc., "User's guide Sell Display to Bid," [online], Internet <URL:http://auction.rakuten.co.jp/guide/main/sell_display.html>

SUMMARY OF INVENTION

Technical Problem

A problem to be solved by the present invention is, concerning products displayed on an online shop using the Internet, to search for information of other products associated with a user's inquiry about a specific product.

Solution to Problem

In order to solve the above problem, a server system of the present invention is one comprising: product information storage means which stores product information containing names of products; text input means which inputs a text for an inquiry about a specific product; product name extraction means which extracts a product name of the specific product from the product information storage means; search condition setting means which sets a search condition using the extracted product name and the input text; product information search means which extracts product information satisfying the set search condition, from the product information storage means; and product information output means which outputs the extracted product information.

Preferably, the search condition setting means is configured to analyze the input text to specify at least one keyword and set a search condition for a search for a product associated with the extracted product name and the specified keyword.

The search condition setting means may be configured to analyze each of the extracted product name and the input text to specify at least one keyword and set a search condition for a search for a product associated with the specified keyword.

Preferably, the product information stored in the product information storage means further contains product descriptions, and the product information search means is configured to extract the product information containing each specified keyword in a product name or in a product description, from the product information storage means.

The server system can be connected to a buyer's terminal, and the text input means may be configured to receive the text about the specific product from the buyer's terminal, and the product information output means may be configured to transmit the extracted product information to the buyer's terminal.

The server system can be connected to each of a buyer's terminal and a seller's terminal, the text input means may be configured to receive the text for the inquiry about the specific product from the buyer's terminal, and the server system may comprise, instead of the product information output means or in addition to the product information output means, text forwarding means which transmits the received text to the seller's terminal of a seller related to the extracted product information.

The server system may further comprise answer text input means which receives an answer text to the text for the inquiry from the seller's terminal; and answer text forwarding means which transmits the received answer text to the buyer's terminal.

The server system may further comprise: buying user information storage means which stores at least user information of buying users containing mail addresses; notification mail generation means which generates a notification mail including identification data of an answer text to the text for the inquiry; and notification mail transmission means which extracts a mail address of a buying user related to the text for the inquiry from the buying user information storage means and transmits the generated notification mail to the mail address.

The server system may further comprise: selling user information storage means which stores at least user information of selling users containing mail addresses; request mail generation means which generates a request mail including identification data of the text for the inquiry; and request mail transmission means which extracts a mail address of a selling user related to the extracted product information, from the selling user information storage means and transmits the generated request mail to the mail address.

In order to solve the above problem, a product recommendation method of the present invention is one in which a computer system that can be connected to a buyer's terminal and that has product information storage means storing product information containing names of products, executes the following steps: a text input step of receiving a text for an inquiry about a specific product from the buyer's terminal; a product name extraction step of extracting a product name of the specific product from the product information storage means; a search condition setting step of setting a search condition using the extracted product name and the input text; a product information search step of extracting product information satisfying the set search condition, from the product information storage means; and a product information output step of transmitting the extracted product information to the buyer's terminal.

In order to solve the above problem, a product recommendation program of the present invention is one for letting a computer system that can be connected to a buyer's terminal and that has product information storage means storing product information containing names of products, execute the following steps: a text input step of receiving a text for an inquiry about a specific product from the buyer's terminal; a product name extraction step of extracting a product name of the specific product from the product information storage means; a search condition setting step of setting a search condition using the extracted product name and the input text; a product information search step of extracting product information satisfying the set search condition, from the product information storage means; and a product information output step of transmitting the extracted product information to the buyer's terminal.

In order to solve the above problem, a recording medium having a computer program recorded thereon is one with a computer program for letting a computer system that can be connected to a buyer's terminal and that has product information storage means storing product information containing names of products, execute the following steps: a text input step of receiving a text for an inquiry about a specific product from the buyer's terminal; a product name extraction step of extracting a product name of the specific product from the product information storage means; a search condition setting step of setting a search condition using the extracted product name and the input text; a product information search step of extracting product information satisfying the set search condition, from the product information storage means; and a product information output step of transmitting the extracted product information to the buyer's terminal.

Advantageous Effects of Invention

With input of a text for an inquiry about a specific product, the server system of the present invention sets a search condition using a product name of the product and the input text, extracts product information satisfying the search condition, from the product information storage means, and outputs the extracted product information.

Therefore, the server system of the present invention is able to search for information of other products associated with the question about the specific product.

A user asking a question about a specific product is highly likely to consider buying the product (or making a bid, order, or the like). Therefore, if the user is suggested (recommended) for the other products associated with the question, a transaction becomes highly likely to be successful. It is the case, particularly, if the other products are sold under the same condition as the product related to the question.

If sellers (displaying users, suppliers, or the like) of the other products are notified of the content of the question, each seller can have an opportunity of an appeal by making an answer to the question. Furthermore, the answer contributes to questioner's product selection.

As described above, the search result output by the server system of the present invention becomes extremely useful information contributing to expansion of business chances in the electronic commerce services (Internet auction services, cybermall services, and so on).

BRIEF DESCRIPTION OF DRAWINGS

FIG. 2 is an explanatory drawing of data items in databases. (Embodiment)

FIG. 6 is a display example of an answer request mail. (Embodiment)

FIG. 10 is an explanatory drawing of data items in databases. (Modification Example 2)

DESCRIPTION OF EMBODIMENTS

<Embodiment>

[1. Outline of Embodiment]

A system of the present embodiment is a system for providing a service to manage Internet auctions ("auction service").

It is assumed in the description below that sales transactions are conducted between sellers (selling users) and bidders (buying users) for auctioned items (which will be referred to hereinafter as "products" in the present embodiment).

The system of the present embodiment is characterized, particularly, in that a buying user asking a question about a specific product is suggested (recommended) for other products associated with the question.

The other points including the system configuration, data processing, etc. except for points explicitly described in particular are the same as in the conventional examples (the systems to provide the services of aforementioned <Prior Art 1> and <Prior Art 2>).

[2. System Configuration]

Figure 1:
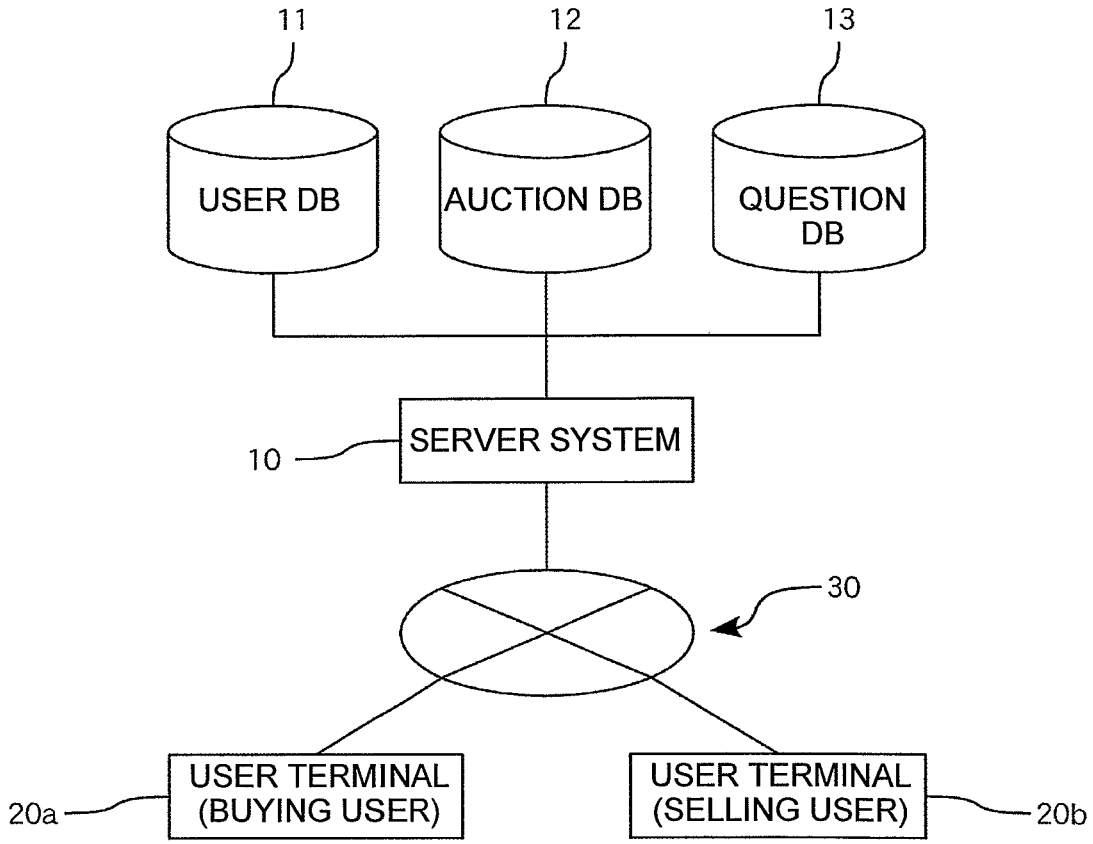
FIG. 1 is a block diagram showing a system configuration. (Embodiment)

FIG. 1 shows the configuration of the system of the present embodiment.

As shown in FIG. 1, the system of the present embodiment is constructed overall with a server system 10, a user terminal 20*a* (terminal of a buying user (buyer's terminal)), and a user terminal 20*b* (terminal of a selling user (seller's terminal)). The server system 10 can be connected to each of the user terminal 20*a* and the user terminal 20*b* through a communication network (Internet 30 in the present embodiment).

The server system 10 has a user DB 11, an auction DB 12, and a question DB 13.

[2-1. Server System]

In FIG. 1, the server system 10 is a server group to provide the auction service.

The server system 10 includes, for example, a Web server having the generation and transmission functions of Web pages, a mail server having the generation and transmission functions of electronic mails, a DB server to manage databases, a batch processing server to execute batch processes, a search processing server to execute a product search process, and other necessary server devices.

[2-2. User DB]

In FIG. 1, the user DB 11 is a database storing information of users in the auction service. In the present embodiment, the user DB 11 stores user information of buying users and user information of selling users with no distinction.

FIG. 2(*a*) shows principal items of the user information.

As shown in FIG. 2(*a*), one piece of user information includes a "user ID," a "password," a "mail address," and a "nickname."

It is noted that the user information of buying users and the user information of selling users may be stored with a distinction. For example, the two groups may be stored in respective separate tables or the user information may be provided with a data item to make a distinction between the two.

[2-3. Auction DB]

In FIG. 1, the auction DB 12 is a database storing information associated with the auction service.

It is assumed in the present embodiment that the auction DB 12 can store multiple pieces of each of product basic information, display information, product price information, and bid information.

FIG. 2(*b*-1) shows principal items of the product basic information.

As shown in FIG. 2(*b*-1), one piece of product basic information includes a "product ID," a "product name," a "product category," a "product description," a "product image URL," and a "product page URL."

It is noted that the "product name" may include features of a product, notes on a transaction of the product, and other additional items, in addition to a name of the product.

FIG. 2(*b*-2) shows principal items of the display information.

As shown in FIG. 2(*b*-2), one piece of display information includes a "display ID," a "product ID," a "user ID" of a selling user (seller), a "starting time" of an auction, an "ending time" of the auction, a "bid ID" of a successful bid candidate, a "status," and a "successful bid date."

The "bid ID" of the successful bid candidate is a "bid ID" of bid information (described later) offering the best "bid price" to a product associated with the display. If the auction ends at this point, a user with this "bid ID" will become a "successful bidder."

The "status" is information indicative of a progress of the auction. It is assumed in the present embodiment that the status is classified at least as "before start" (default), "in progress," "sold," "end without successful bid," and so on.

The server system 10 performs predetermined batch processes to update the "status" from "before start" to "in progress" at the "starting time" of the auction and to update the "status" from "in progress" to "sold" or "end without successful bid" according to a situation at the "ending time" of the auction.

FIG. 2(*b*-3) shows principal items of the product price information.

As shown in FIG. 2(*b*-3), one piece of product price information includes a "display ID," an "initial price," and a "current price."

The "initial price" herein is a price of an objective product at the starting time of the auction. The "current price" is the best price (the default of which is the "initial price") out of one or more bid prices and is updated according to needs every bidding. The "initial price" is assumed to be set by the seller (selling user).

FIG. 2(*b*-4) shows principal items of the bid information.

As shown in FIG. 2(*b*-4), one piece of bid information includes a "bid ID," a "display ID," a "user ID" of a buying user (bidder), and a "bid price."

[2-4. Question DB]

In FIG. 1, the question DB 13 is a database storing information associated with questions and answers in the auction service.

It is assumed in the present embodiment that the question DB 13 can store multiple pieces of each of the question information and answer information.

FIG. 2(*c*-1) shows principal items of the question information.

As shown in FIG. 2(*c*-1), one piece of question information includes a "question ID," a "user ID" of a buying user (questioner), a "display ID" associated with an objective product, and a "question text."

The question information may include a "product ID" of the objective product and a user ID of a seller of the objective product, instead of the "display ID."

FIG. 2(*c*-2) shows principal items of the answer information.

As shown in FIG. 2(*c*-2), one piece of answer information includes an "answer ID," a "question ID" related to corresponding question information, a "user ID" of a selling user (answerer), a "display ID" related to an objective product, and an "answer text."

The answer information may include a "product ID" of the objective product, instead of the "display ID."

[2-5. User Terminals]

In FIG. 1, the user terminal 20*a* and the user terminal 20*b* are terminals used by users of the auction service.

The user terminal 20*a* and the user terminal 20*b* each have a Web browser and can retrieve a Web page received from the server system 10 and display it on a display. Furthermore, the user terminal 20*a* and the user terminal 20*b* each have a mailer and can retrieve an e-mail message received from the server system 10 and display it on the display.

The user terminals 20*a* and 20*b* may be any existing information processing terminals with a communication function (e.g., electronic computers such as personal computers, or the like).

[3. Question Acceptance Process]

[3-1. Procedure]

Figure 3:
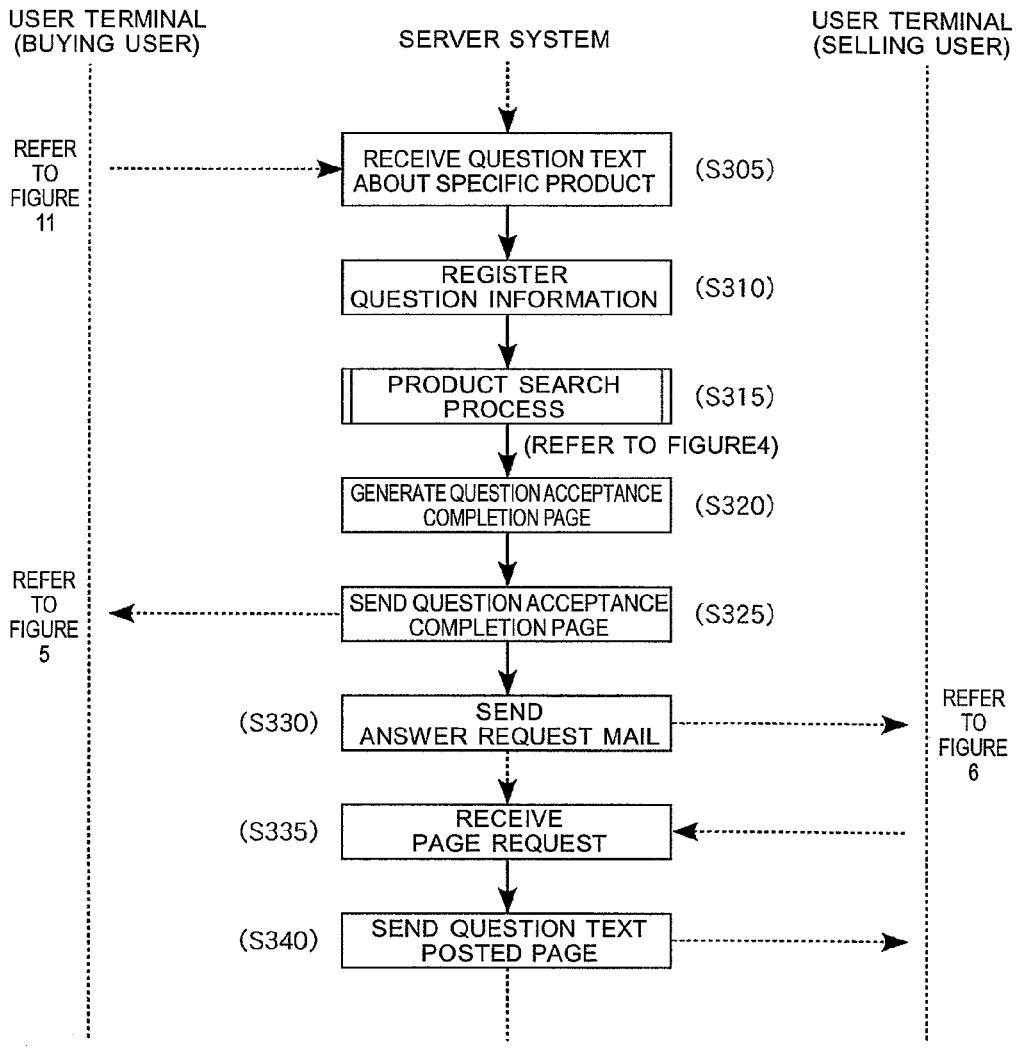
FIG. 3 is a flowchart showing a procedure of a question acceptance process. (Embodiment)

FIG. 3 shows a procedure of a question acceptance process carried out by the server system 10.

Figure 14:
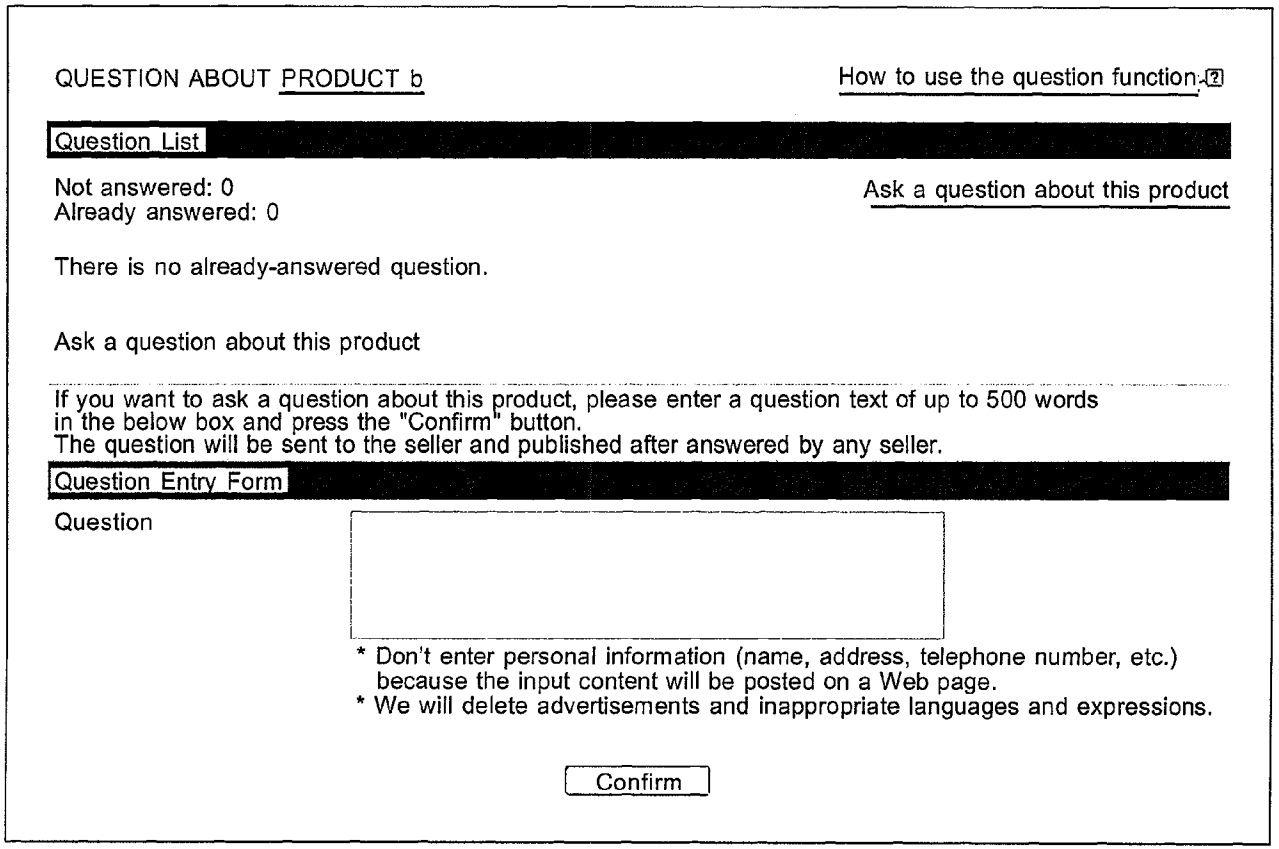
FIG. 14 is a display example of a question entry page. (Prior Art 2)

It is assumed as a premise that the buying user (questioner) of the product manipulates the user terminal 20*a* to log in the auction service on the basis of the "user ID" and "password." It is also assumed that the user (questioner) has already entered a question text in a predetermined question entry page (cf. FIG. 14).

The below will describe the procedure on the assumption of a situation in which the server system 10 accepts a question about a product b from the buying user A (questioner) to the selling user B.

[11] The server system receives a question text about the specific product from the user terminal 20*a* (S305). Subsequently, the server system registers the question information in the question DB 13 (S310, FIG. 2(*c*-1)). The question text is assumed to be transmitted along with the display ID (or the product ID and the user ID of the selling user) and to be registered in association with the data.

Figure 4:
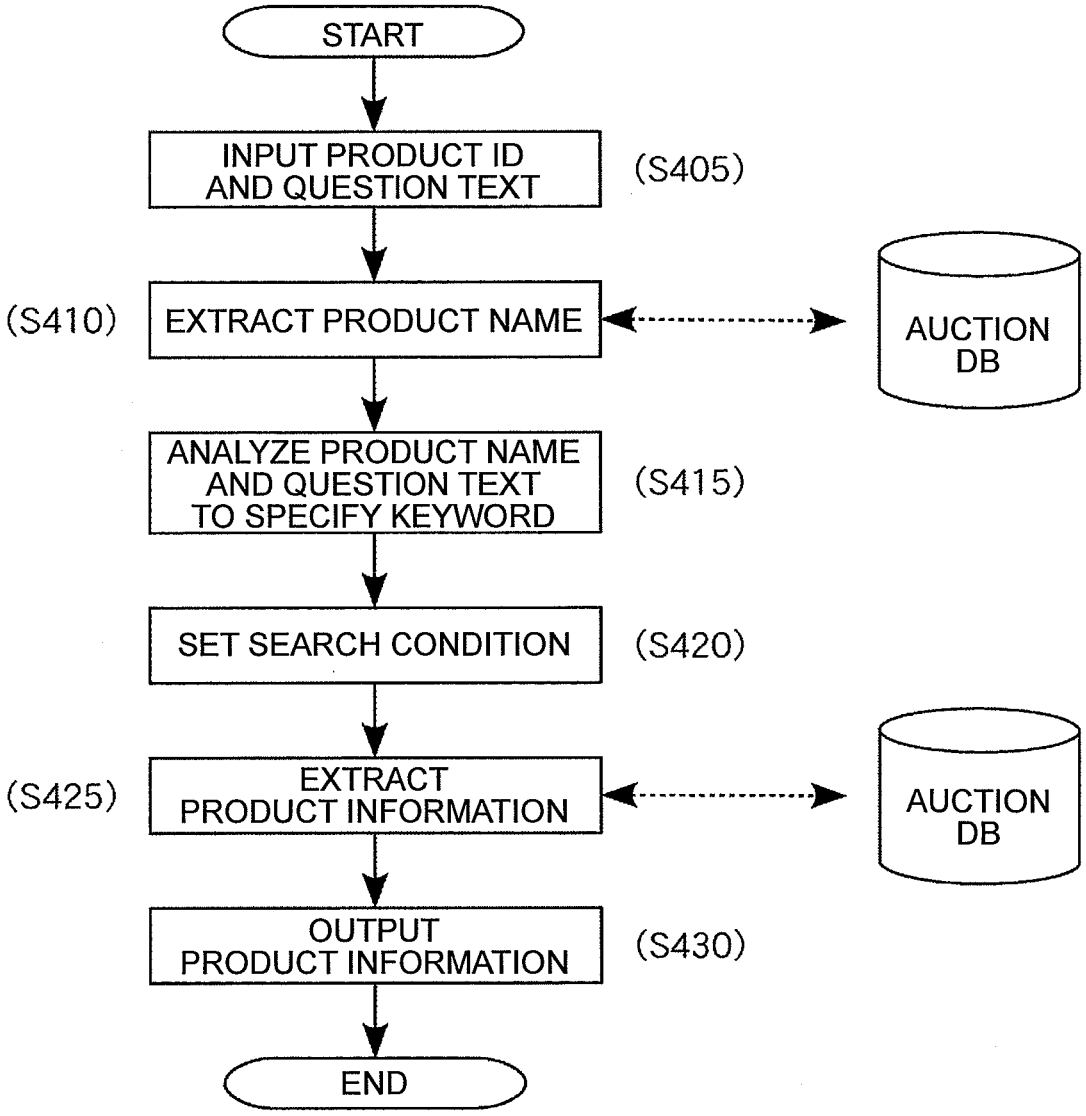
FIG. 4 is a flowchart showing a procedure of a product search process. (Embodiment)

[12] The server system executes a product search process (S315, FIG. 4). In this process the server system searches for other products associated with the question text about the specific product.

Figure 5:
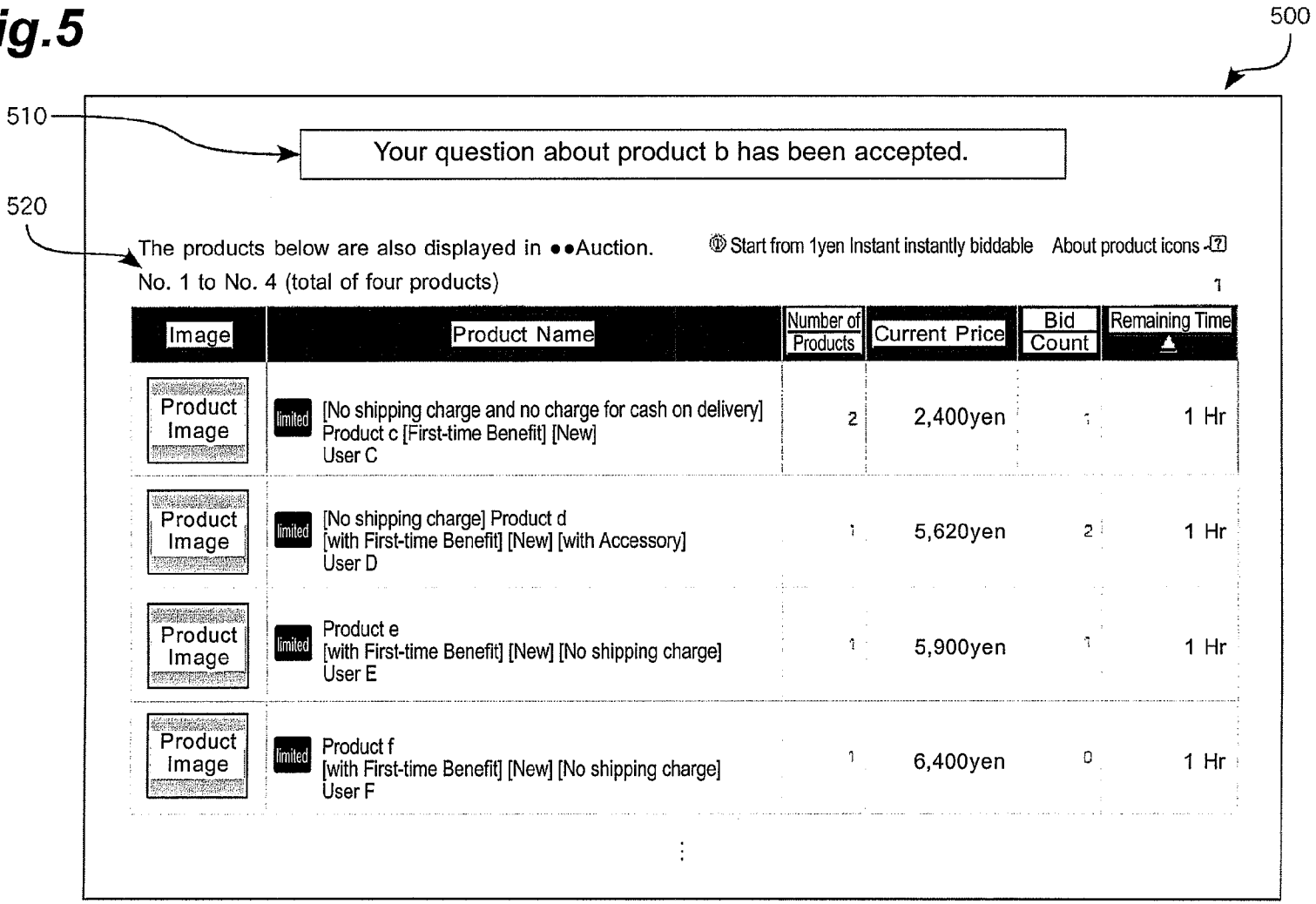
FIG. 5 is a display example of a question acceptance completion page. (Embodiment)

[13] The server system generates a question acceptance completion page using the product search result (S320) and transmits it to the user terminal 20*a* (S325, FIG. 5).

[14] The server system generates an answer request mail for the question and transmits it to mail addresses of sellers (selling users) of the other products associated with the question (S330, FIG. 6). The mail addresses of the respective sellers (selling users) are extracted from the user information (FIG. 2(*a*)) in the user DB 11.

[15] Thereafter, when the server system receives a page request from the user terminal 20*b* (S335), it transmits a question text posted page to the user terminal 20*b* (S340).

[3-2. Product Search Process]

[(a) Procedure]

FIG. 4 shows a procedure of the product search process carried out by the server system 10.

[21] The server system inputs a product ID and a question text (text) about a question (S405).

[22] The server system extracts a product name corresponding to the product ID from the product basic information (FIG. 2(*b*-1)) in the auction DB 12 (S410).

[23] The server system analyzes each of the product name and the question text (e.g., by the morphological analysis if the product name and question text are Japanese), to specify one or more keywords (S415). For example, when the question text is "fuzokuhin•ha•ari•masu•ka? (Is there any accessory?)," execution of the morphological analysis results in dividing the sentence into words of "fuzokuhin : accessory," "ha," "ari," "masu," and "ka." At this time, for example, a noun ("fuzokuhin") is specified as a keyword out of the question text. This process results in specifying the name of the product and the word "fuzokuhin" extracted from the question text, as keywords for a search. In another case, for example, where the product name and question text are English, a noun or nouns therein are extracted to specify one or more keywords. Of course, in the case of the languages other than Japanese and English (e.g., Chinese, Korean, Spanish, and so on), the product name and question text each are analyzed in the respective languages to extract a noun or nouns thereby to specify one or more keywords.

Besides the name of the product, the search keywords to be extracted are, for example, "new/used," "first-time benefit," "accessory," "shipping charge," etc. according to the content of the question text.

[24] The server system sets a search condition for a search for products associated with each specified keyword (S420). For example, in the case where the question text is "fuzokuhin•ha•ari•masu•ka? (Is there any accessory?)" as described above, the name of the product and the word "fuzokuhin : accessory" specified from the question text are set as search keywords. The server system extracts necessary items out of product information satisfying the search condition, from the product basic information, display information, and product price information (FIGS. 2(*b*-1) to (*b*-3)) in the auction DB 12 (S425). For example, the server system may extract product information including each keyword in its product name or/and in its product description.

[25] The server system outputs necessary items out of the extracted product information (S430).

[(b) Search Technique]

In the above process [24], the server system 10 sets the search condition (S420) and extracts the product information satisfying the search condition, from the auction DB 12 (S425).

The server system may select any condition, for example, from the conditions below, to preliminarily narrow down objects of the search.

An object should belong to a "product category" identical to or closely related to the "product category" (FIG. 2(*b*-1)) of the product concerning the question.

The "status" (FIG. 2(*b*-2)) of an auction of an object should be "in progress."

If the "product name" (FIG. 2(*b*-1)) is assumed to contain only a name of a product, the server system can set the search condition for the search for products associated with the product name and the keyword extracted from the question text.

Furthermore, an object of the search may be separately set for the product information associated with a displayed product with the "status" of "end without successful bid," as a destination of the answer request mail (S330 in FIG. 3, FIG. 6).

The other technique of the search may be the same as in the conventional example (the search function in <Prior Art 1> above).

[3-3. Question Acceptance Completion Page]

[(a) Display Example]

FIG. 5 shows a display example of the question acceptance completion page. The question acceptance completion page 500 is a display example of a Web page to be transmitted to the user terminal 20*a* in response to acceptance of a question from the user terminal 20*a*.

As shown in FIG. 5, the question acceptance completion page 500 includes the following pieces of information.

Acknowledgement of acceptance of a question about a specific product ("product b") (510).

List of other products associated with a question text about the specific product ("product b") (e.g., "product c" to "product f" output as the search result of the product search process (S315 in FIG. 3, FIG. 4) (520).

The configuration of the product list part (520) may be the same as the search result screen in the conventional example (the product search in the service of <Prior Art 1> above). For example, product images and product names are linked to product pages.

[(b) Effect]

In the present embodiment, as described above, the information of the other products associated with the question is displayed on the question acceptance completion page, whereby the other products are suggested (recommended) to the user asking the question.

The user making the question about the specific product is highly likely to consider making a bid for the product. Therefore, when the other products associated with the question are suggested (recommended) to the user, a transaction can become successful with a high possibility. It is the case, especially, if the other products are sold under the same condition as the product related to the question.

Particularly, since there is a time lag from acceptance of the question to disclosure of an answer (cf. <Prior Art 2> above), a business chance enhancement effect becomes extremely high by the display of the information of the other products in association with the question on the question acceptance completion page.

[3-4. Answer Request Mail]

[(a) Display Example]

FIG. 6 shows a display example of the answer request mail. The answer request mail 600 is a display example of an e-mail message to be transmitted to the user terminal 20*b* of each of sellers of the other products associated with the question text with acceptance of the question from the user terminal 20*a*.

As shown in FIG. 6, the answer request mail 600 is composed of a sender field (610), a title field (620), and a message field (630). The below will describe an example of the answer request mail transmitted to a mail address of a seller C of another product c in association with a question text about a specific product b.

A notice that there is a question about a product is described in the title field (620).

The following pieces of information are included in the message field (630).

Acknowledgement that there is a user asking a question about a product associated with (similar to herein) the product c displayed by the user C (631).

Information (product name, status, product page URL, etc.) about the product c displayed by the user C (632).

Statement that an answer to the question can make an appeal of the product c to the questioner, and notes of caution about the answer (633). For example, the notes of caution include: (1) No answer should be made if the product c is not suitable for the question; (2) The content of an answer will be published along with the content of the question; (3) An answer is allowed only during progress of the auction, and so on.

URL of a Web page for an answer (634). The URL includes a question ID (value of "qid" herein) as a parameter.

[(b) Effect]

In the present embodiment, as described above, the notice that there is a user asking a question about the other associated product (similar product) is described in the answer request mail, whereby the seller of the associated product (similar product) is notified of the existence of the questioner.

The user asking the question about the specific product is highly likely to consider making a bid for the product. Therefore, when the seller of the other associated product (similar product) is notified of the existence of the user, the seller can be given a chance of an appeal by answering the question.

Particularly, since it is extremely difficult for a seller to specify a user considering making a bid for a product related to a displayed product of his or her own or for a product associated therewith (or similar thereto), by himself or herself, the business chance enhancement effect becomes extremely high by describing the existence of the questioner on the answer request mail.

[3-5. Forwarding of Question Text]

In the above process [15], the server system 10 receives the page request from the user terminal 20*b* (S335) and transmits the question text posted page to the user terminal 20*b* (S340).

In the present embodiment, as described above, the notice that there is a user asking a question about the other associated product (similar product) is described in the answer request mail and the question text is disclosed in response to a request from the seller of the associated product (similar product).

By this operation, we can expect an effect of indirectly promoting competitions between the seller (selling user) of the specific product related to the question and sellers (selling users) of the other products associated with the question.

[4. Answer Acceptance Process]

[4-1. Procedure]

Figure 7:
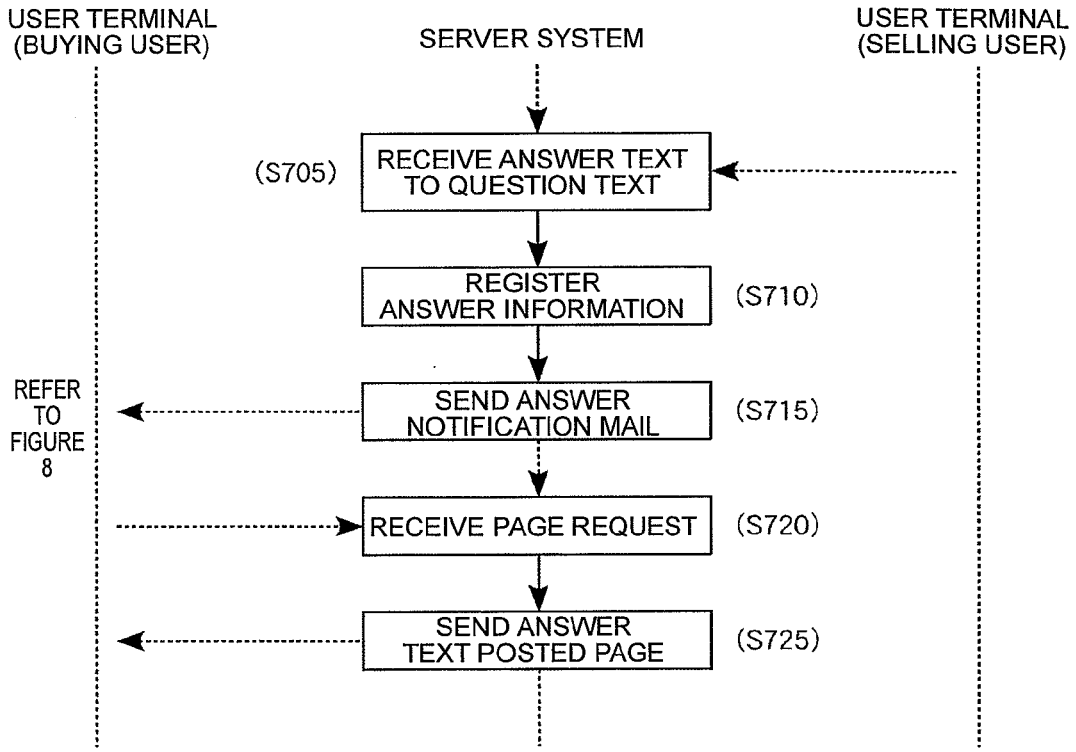
FIG. 7 is a flowchart showing a procedure of an answer acceptance process. (Embodiment)

FIG. 7 shows a procedure of an answer acceptance process carried out by the server system 10.

It is assumed as a premise that a selling user (answerer) of a product has manipulated the user terminal 20*b* to log in the auction service on the basis of the "user ID" and "password." It is further assumed that the answerer has already entered an answer text on a predetermined answer entry page (not shown).

The below will describe the procedure on the assumption of a situation in which an answer aiming at the product c by the selling user C (answerer) is accepted to the question about the product b by the buying user A.

[31] The server system receives an answer text to the question text from the user terminal 20*b* (S705). Subsequently, the server system registers answer information in the question DB 13 (S710, FIG. 2(*c*-2)). The answer text is assumed to be transmitted together with the display ID (or the product ID and the user ID of the selling user) and to be registered in association with the data and the question ID.

Figure 8:
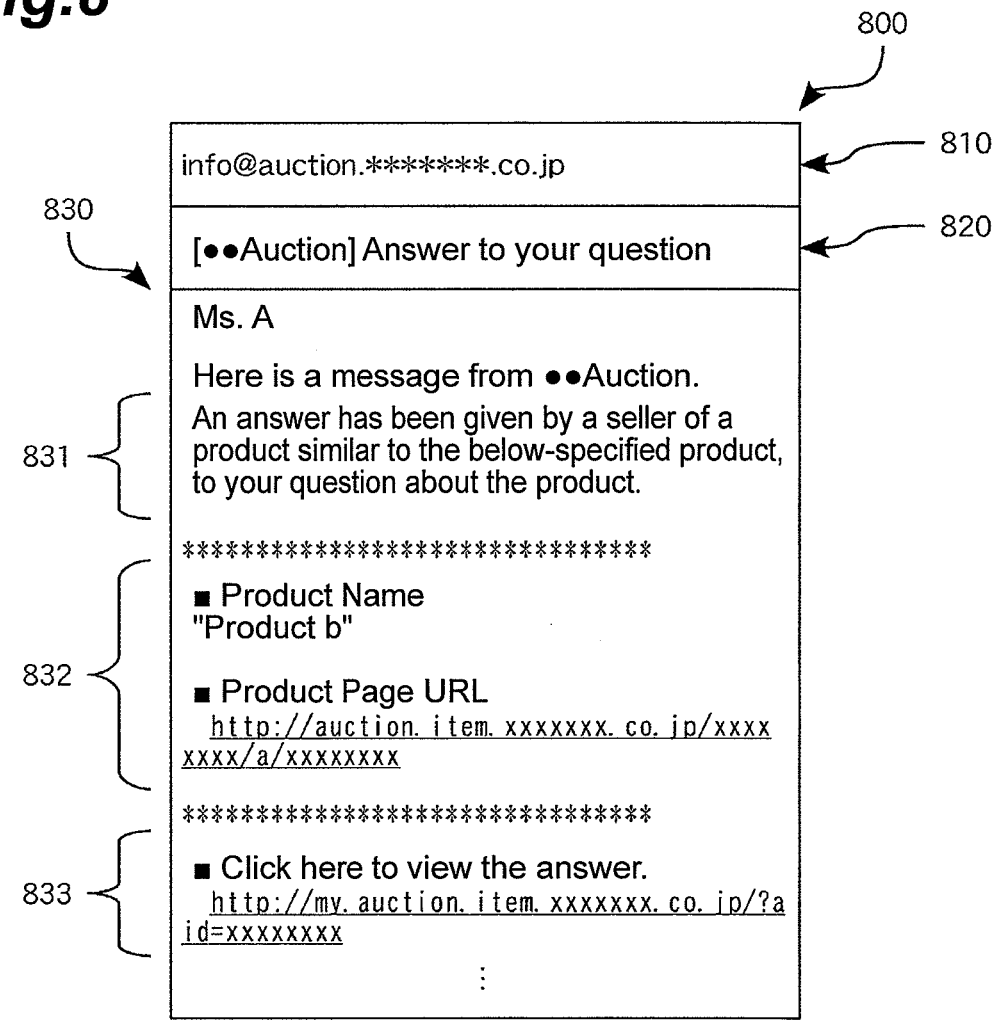
FIG. 8 is a display example of an answer notification mail. (Embodiment)

[32] The server system generates an answer notification mail and sends the mail to a mail address of a questioner (buying user) (S715, FIG. 8). The mail address of the questioner (buying user) is extracted from the user information (FIG. 2(*a*)) in the user DB 11.

[33] Thereafter, when the server system receives a page request from the user terminal 20*a* (S720), it transmits an answer text posted page to the user terminal 20*a* (S725).

[4-2. Answer Notification Mail]

[(a) Display Example]

FIG. 8 shows a display example of an answer notification mail.

The answer notification mail 800 is a display example of an e-mail message to be transmitted to the user terminal 20*a* of the questioner with acceptance of an answer from the user terminal 20*b*.

As shown in FIG. 8, the answer notification mail 800 is composed of a sender field (810), a title field (820), and a message field (830). The below will describe an example of the answer notification mail transmitted to the mail address of the questioner A asking the question about the specific product b.

A notice that there is an answer to the question is described in the title field (820).

The following pieces of information are included in the message field (830).

Acknowledgement that an answer from a seller of an associated (similar) product is published to the question about the specific product b by the user A (831).

Information of the product b related to the question of the user A (product name, product page URL, etc.) (832).

URL of the answer text posted page (833). The URL is assumed to include an answer ID (value of "aid" herein) as a parameter.

[(b) Effect]

In the present embodiment, as described above, the notice that there is an answer from a seller of an associated product (similar product) to the product related to the question is described in the answer notification mail, whereby the questioner is notified of the existence of the related product (similar product).

The user asking the question about the specific product is highly likely to consider making a bid for the product. Therefore, the answer from the seller of the other product in association with the question is useful information contributing to product selection by the questioner.

[4-3. Forwarding of Answer Text]

In the above process [33], the server system 10 receives the page request from the user terminal 20*a* (S720) and transmits the answer text posted page to the user terminal 20*a* (S725).

In the present embodiment, as described above, the notice that there is an answer from a seller of an associated product (similar product) to the product related to the question is described in the answer notification mail and then the answer text is disclosed in accordance with a request from the questioner.

By this operation, we can expect an effect of indirectly promoting competitions between the seller (selling user) of the specific product related to the question and the sellers (selling users) of the other products associated with the question.

[5. Modification Examples]

[(Modification Example 1) Implementation of Question Forwarding and Answer Forwarding Only]

The above embodiment involves the suggestion (recommendation) of products associated with a product related to a question on the question acceptance completion page and further involves implementation of question forwarding and answer forwarding (cf. FIG. 3, FIG. 7, etc.).

In contrast to it, the system may be configured with implementation of question forwarding and answer forwarding only, without suggestion (recommendation) of products associated with a product related to a question on the question acceptance completion page.

[(Modification Example 2) Execution in Cybermall Service]

The foregoing embodiment is the example where the present invention is carried out in the auction service.

In contrast to it, the present invention can also be carried out in a service to manage an online shopping mall (cybermall) ("cybermall service"), with much the same effect as in the case where the present invention is carried out in the auction service.

[(a) Modification of System Configuration]

Figure 9:
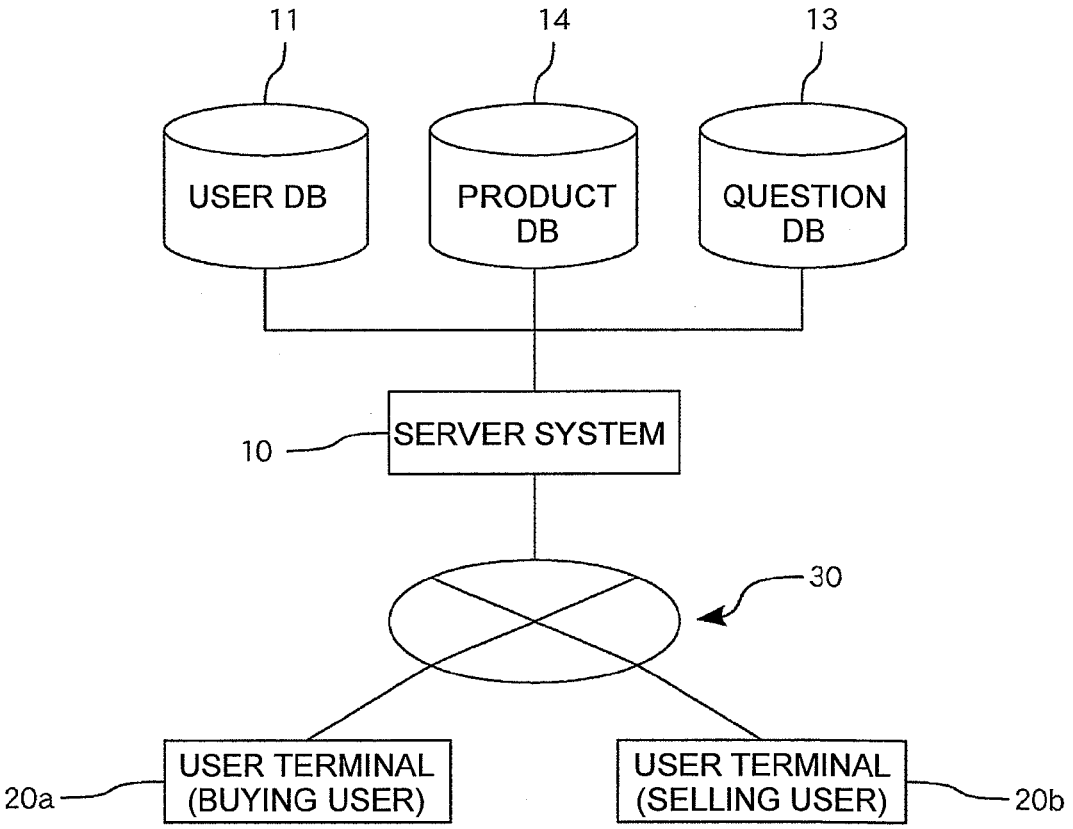
FIG. 9 is a block diagram showing a system configuration. (Modification Example 2)

FIG. 9 shows a configuration of a system of Modification Example 2. Unless otherwise noted in particular, the elements with the same reference signs as those in FIG. 1 are assumed to have the same functions and to execute the same processing.

As shown in FIG. 9, the system of Modification Example 2 is constructed overall with a server system 10, a user terminal 20*a* (terminal of a buying user (buyer's terminal)), and a user terminal 20*b* (terminal of a selling user (seller's terminal)). The server system 10 can be connected to each of the user terminals 20*a* and 20*b* through a communication network (Internet 30 in the present embodiment).

The server system 10 has a user DB 11, a product DB 14, and a question DB 13.

[(b) Modification of Data Items]

In FIG. 9, the product DB 14 is a database storing information of products in a cybermall service.

FIG. 10(*b*) shows principal items of the product information.

As shown in FIG. 10(*b*), one piece of product information contains a "product ID," a "product name," a "product category," a "product description," a "product image URL," a "product page URL," a "user ID" of a selling user, and a "product price."

The "product name" may include, for example, features of a product, notes of a transaction for the product, and other additional items, in addition to a name of the product.

The items of the user information (FIG. 10(*a*)) in Modification Example 2 are the same as those of the user information (FIG. 2(*a*)) in the embodiment.

The items of the question information (FIG. 10(*c*-1)) and the answer information (FIG. 10(*c*-2)) in Modification Example 2 are the same as those of the question information and the answer information (FIG. 2(*c*-1) and FIG. 2(*c*-2)) in the embodiment, except that the "display ID" is replaced by "product ID."

[(c) Modification of Question Acceptance Process Procedure]

Figure 11:
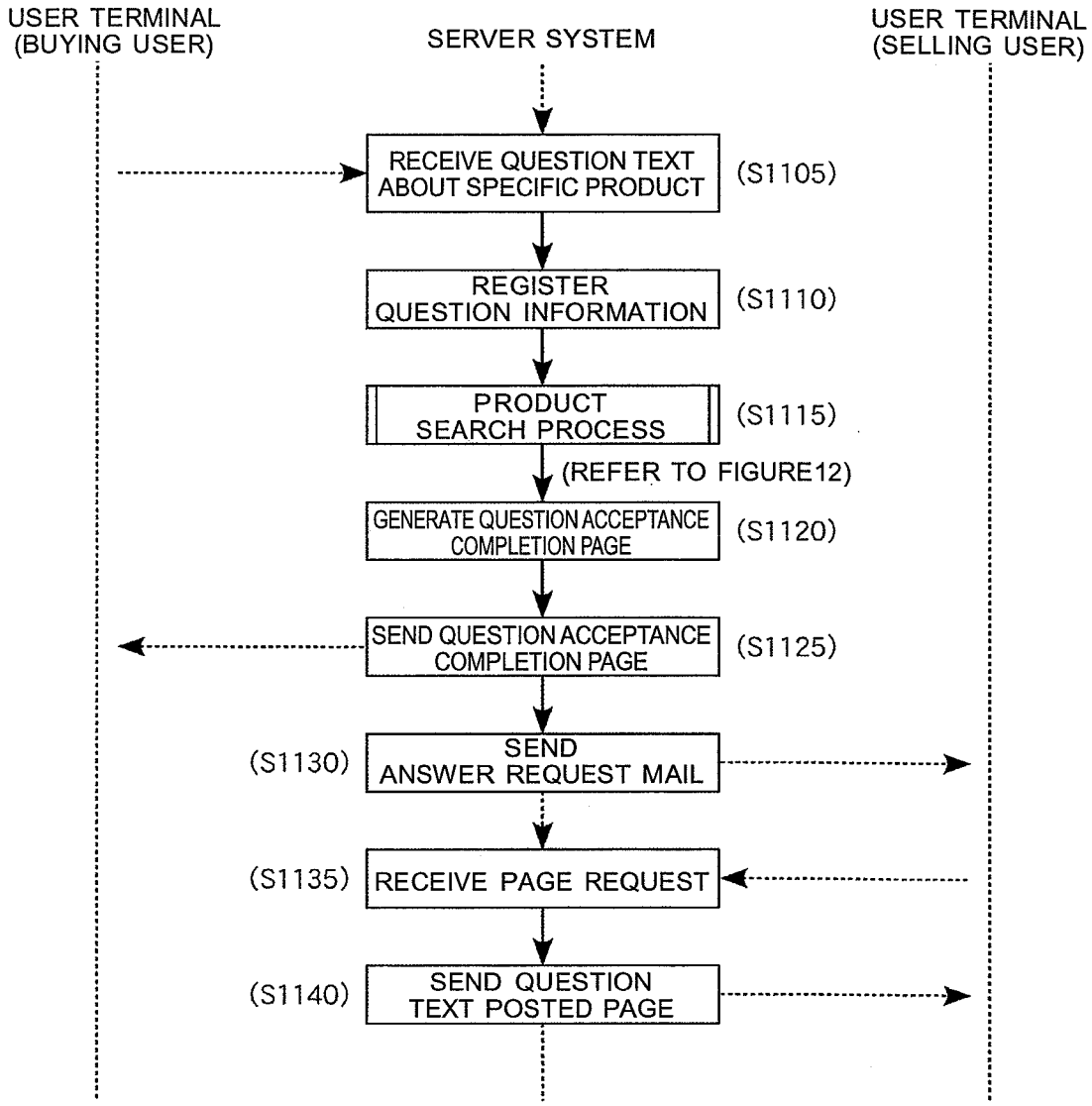
FIG. 11 is a flowchart showing a procedure of a question acceptance process. (Modification Example 2)

FIG. 11 shows a modification example of the question acceptance process procedure carried out by the server system 10.

The question acceptance process procedure of Modification Example 2 is much the same as the question acceptance process procedure (FIG. 3) in the embodiment.

[41] The server system receives a question text about a specific product from the user terminal 20*a* (S1105). Subsequently, the server system registers the question information in the question DB 13 (S1110, FIG. 10(*c*-1)). The question text is assumed to be transmitted together with the product ID and the user ID of the selling user and to be registered in association with the data.

[42] The server system executes the product search process (S1115). In this step the server system searches for other products associated with the question text about the specific product.

[43] The server system generates a question acceptance completion page, using the product search result (S1120) and transmits it to the user terminal 20*a* (S1125).

[44] The server system generates an answer request mail to the question and transmits it to a mail address of each of sellers (selling users) of the other products associated with the question (S1130). The mail addresses of the respective sellers (selling users) are extracted from the user information (FIG. 10(*a*)) in the user DB 11.

[45] Thereafter, when the server system receives a page request from the user terminal 20*b* (S1135), it transmits a question text posted page to the user terminal 20*b* (S1140).

[(d) Modification of Product Search Process Procedure]

Figure 12:
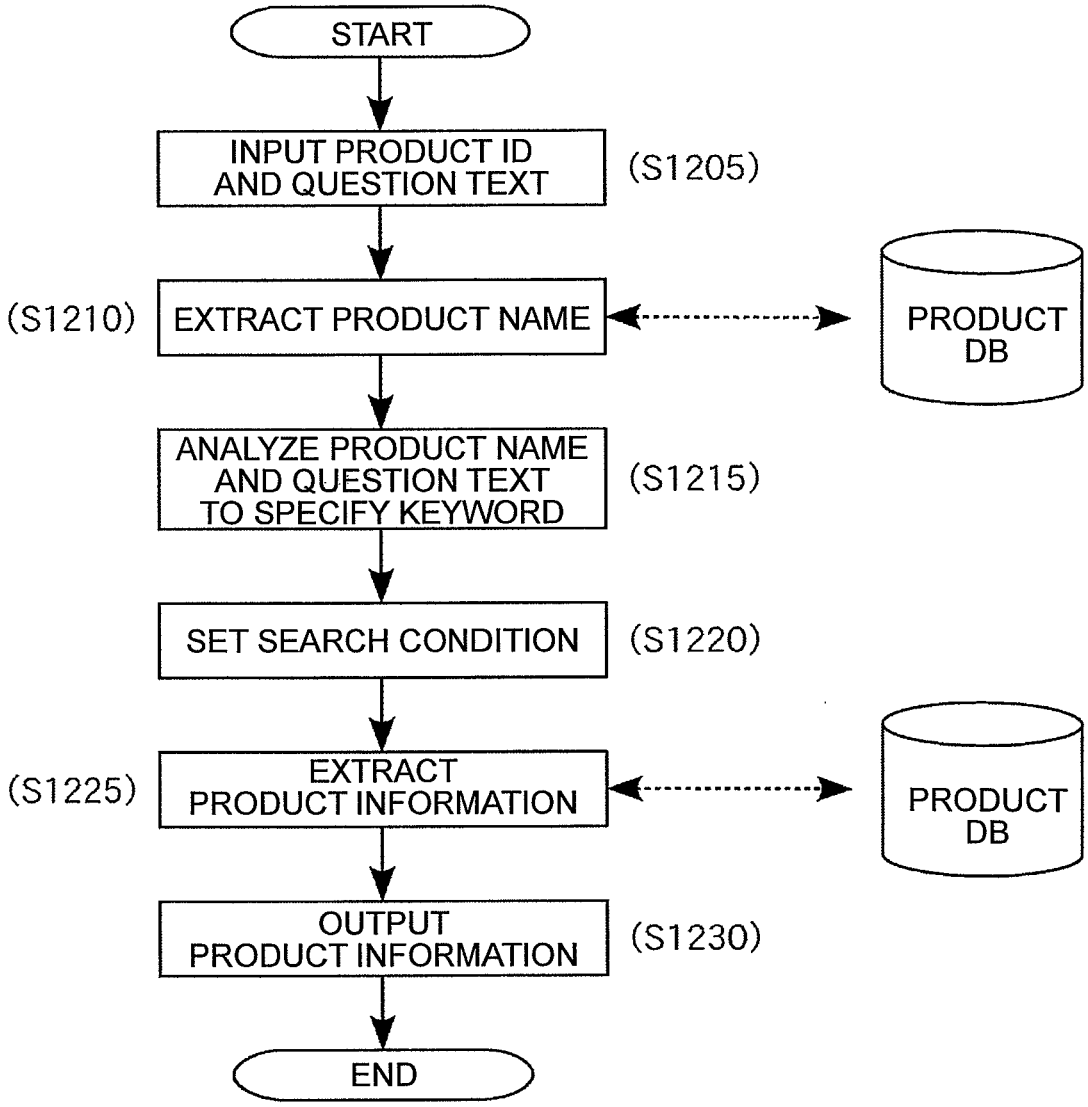
FIG. 12 is a flowchart showing a procedure of a product search process. (Modification Example 2)

FIG. 12 shows a modification example of the product search process procedure carried out by the server system 10.

The product search process procedure of Modification Example 2 is much the same as the product search process procedure (FIG. 4) in the embodiment.

[51] The server system inputs a product ID and a question text (text) related to a question (S1205).

[52] The server system extracts a product name corresponding to the product ID from the product basic information (FIG. 10(*b*)) in the product DB 14 (S1210).

[53] The server system analyzes each of the product name and question text (e.g., by the morphological analysis if the product name and question text are Japanese) to specify one or more keywords (S1215). For example, when the question text is "fuzokuhin•ha•ari•masu•ka? (Is there any accessory?)," execution of the morphological analysis results in dividing the sentence into words of "fuzokuhin : accessory," "ha," "ari," "masu," and "ka." At this time, for example, a noun ("fuzokuhin") is specified as a keyword from the question text. This process results in specifying the name of the product and the word "fuzokuhin" extracted from the question text as keywords for the search. In another case where the product name and question text are English, a noun or nouns included therein are extracted to specify one or more keywords. Of course, in the case of the languages other than Japanese and English (e.g., Chinese, Korean, Spanish, etc.), the product name and question text in each of the languages are analyzed to extract a noun or nouns, thereby specifying one or more keywords.

The keywords to be extracted for the search include, for example, "new/used," "first-time benefit," "accessory," "shipping charge," etc. according to the content of the question text, in addition to the name of the product.

[54] The server system sets a search condition for a search for products associated with each specified keyword (S 1220). For example, in the case where the question text is "fuzokuhin•ha•ari•masu•ka? (Is there any accessory?)" as described above, the name of the product and the word "fuzokuhin" extracted from the question text are set as keywords for the search. The server system extracts necessary items out of the product information satisfying the search condition, from the product information (FIG. 10(*b*)) in the product DB 14 (S1225). For example, it may extract the product information containing each keyword in the product name or/and in the product description.

[55] The server system outputs necessary items out of the extracted product information (S1230).

[(e) Modification of Answer Acceptance Process Procedure]

Figure 13:
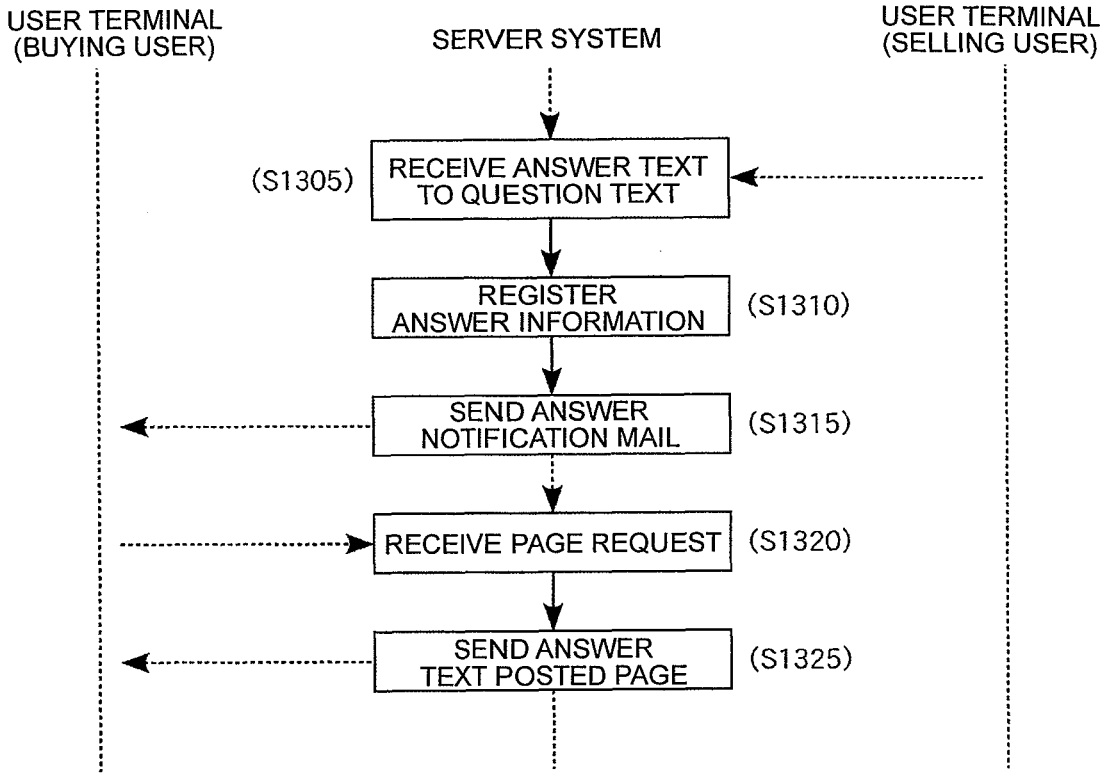
FIG. 13 is a flowchart showing a procedure of an answer acceptance process. (Modification Example 2)

FIG. 13 shows a modification example of the answer acceptance process procedure carried out by the server system 10.

The answer acceptance process procedure of Modification Example 2 is much the same as the answer acceptance process procedure (FIG. 7) in the embodiment.

[61] The server system receives an answer text to the question text from the user terminal 20*b* (S1305). Subsequently, the server system registers the answer information in the question DB 13 (S1310, FIG. 10(*c*-2)). The answer text is assumed to be transmitted together with the product ID and the user ID of the selling user and to be registered in association with the data and question ID.

[62] The server system generates an answer notification mail and sends it to a mail address of a questioner (buying user) (S1315). The mail address of the questioner (buying user) is extracted from the user information (FIG. 10(*a*)) in the user DB 11.

[63] Thereafter, when the server system receives a page request from the user terminal 20*a* (S1320), it transmits an answer text posted page to the user terminal 20*a* (S1325).

[(f) Other Modifications]

Texts of Web pages and e-mail messages to be adopted are those suitable for the cybermall service.

In the above embodiment the question text was the text input into and processed by the server system 10, but the text does not always have to be limited to the question; for example, the text may be any statement for an inquiry about a specific product such as a request or a desire.

The below will describe a program for letting a computer execute the aforementioned sequential processing of the server system 10. The program is stored in a program storage region formed on a recording medium which is put into a computer and accessed thereby, or which is equipped in a computer.

The program is provided with modules corresponding to the aforementioned functions of the server system 10 and the aforementioned functions are implemented through execution of those modules. The program may be configured in such a manner that a part or whole thereof is transmitted through a transmission medium such as a communication line and received by another device to undergo recording (including installation). The modules of the program may be installed in any of a plurality of computers, instead of a single computer. In that case, the aforementioned sequential processing is carried out by a computer system consisting of the plurality of computers.

List Of Reference Signs

10 server system
11 user DB
12 auction DB
13 question DB
14 product DB
20*a* user terminal (buying user)
20*b* user terminal (selling user)
30 Internet
500 question acceptance completion page
600 answer request mail
800 answer notification mail

The invention claimed is:

1. A server system comprising:

a product information storage unit which stores product information containing names of products;

a text input unit which receives text for an inquiry corresponding to only a specific product for a first seller of the specific product from a buyer's terminal, using an entry page for the specific product;

a product name extraction unit which extracts a product name of the specific product from the product information storage unit responding to the input text for the inquiry about the specific product;

a search condition setting unit which sets a search condition for another product using the extracted product name and a keyword indicating a category different from a category of the specific product, wherein the keyword is based on the input text;

a product information search unit which extracts product information of only the other product satisfying the set search condition, from the product information storage unit;

a product information output unit which outputs the extracted product information about only the other product satisfying the set search condition;

a text forwarding unit which forwards the received text for the first seller of the specific product to a second seller's terminal of the second seller of the other product related to the extracted product information;

an answer text input unit which receives an answer text to the text for the inquiry, from the second seller's terminal of the second seller of the other product; and an answer text forwarding unit which transmits the received answer text to the buyer's terminal.

2. The server system according to claim 1, wherein the search condition setting unit analyzes the input text to specify at least one keyword and sets a search condition for a search for a product associated with the extracted product name and the specified keyword.

3. The server system according to claim 2, wherein the search condition setting unit analyzes each of the extracted product name and the input text to specify at least one keyword and sets a search condition for a search for a product associated with the specified keyword.

4. The server system according to claim 2, wherein the product information stored in the product information storage unit further contains product descriptions, and wherein the product information search unit extracts the product information containing each specified keyword in a product name or in a product description, from the product information storage unit.

5. The server system according to claim 1, which can be connected to a buyer's terminal, wherein the search condition setting unit sets the search condition as triggered by receiving text for the inquiry about the specific product from the text input unit, and wherein the product information output unit includes the extracted product information which information of the received text for the inquiry about the specific product being accepted and transmits it to the buyer's terminal.

6. The server system according to claim 1, further comprising:

a buying user information storage unit which stores at least user information of buying users containing mail addresses;

a notification mail creation unit which creates a notification mail including identification data of an answer text to the text for the inquiry; and a notification mail transmission unit which extracts a mail address of a buying user related to the text for the inquiry from the buying user information storage unit and transmits the created notification mail to the mail address.

7. The server system according to claim 1, further comprising:

a selling user information storage unit which stores at least user information of selling users containing mail addresses;

a request mail creation unit which creates a request mail including identification data of the text for the inquiry; and a request mail transmission unit which extracts a mail address of a selling user related to the extracted product information, from the selling user information storage unit and transmits the created request mail to the mail address.

8. The server system according to claim 1, wherein extraction of a product name by the product name extraction unit and extraction of product information by the product information search unit are conducted from the same database that is the product information storage unit.

9. The server system according to claim 1, wherein the search condition setting unit analyzes the input text to specify at least one keyword based on a morphological analysis and sets a search condition for a search for a product associated with the extracted product name and the specified keyword.

10. A product recommendation method in which a computer system that can be connected to a buyer's terminal and that has a product information storage unit storing product information containing names of products, executes:

a text input step of receiving from the buyer's terminal a text for an inquiry corresponding to only a specific product to a seller of the specific product, using an entry page for the specific product;

a product name extraction step of extracting a product name of the specific product from the product information storage unit responding to the input text for the inquiry about the specific product;

a search condition setting step of setting a search condition using the extracted product name and a keyword indicating a category different from a category of the specific product, wherein the keyword is based on the input text;

a product information search step of extracting product information of only another product satisfying the set search condition, from the product information storage unit;

a product information output step of transmitting the extracted product information about only the other product satisfying the set search condition to the buyer's terminal; and a text forwarding step of forwarding the text of the inquiry for the seller of the specific product to a seller's terminal of a seller of the other product related to the extracted product information;

an answer text input unit which receives an answer text to the first inquiry, from the seller's terminal of the seller of the other product; and an answer text forwarding unit which transmits the received answer text to the buyer's terminal.

11. A non-transitory recording medium having a computer program recorded thereon, the computer program letting a computer system that can be connected to a buyer's terminal and that has a product information storage unit storing product information containing names of products, execute:

a text input step of receiving from the buyer's terminal a text for an inquiry corresponding to only a specific product to a seller of the specific product, using an entry page for the specific product;

a product name extraction step of extracting a product name of the specific product from the product information storage unit responding to the input text for the inquiry about the specific product;

a search condition setting step of setting a search condition for another product using the extracted product name and a keyword indicating a category different from a category of the specific product, wherein the keyword is based on the input text;

a product information search step of extracting product information of only the other product satisfying the set search condition, from the product information storage unit;

a product information output step of transmitting the extracted product information about only the other product satisfying the set search condition information to the buyer's terminal; and a text forwarding step of forwarding the text of the inquiry for the seller of the specific product to a seller's terminal of a seller of the other product related to the extracted product information;

an answer text input unit which receives an answer text to the first inquiry, from the seller's terminal of the seller of the other product; and an answer text forwarding unit which transmits the received answer text to the buyer's terminal.

12. A server system comprising:

a product information storage unit which stores product information containing names of products;

a text input unit which receives a first inquiry corresponding to only a first product directed to a seller of the first product from the buyer's terminal, using a page for the first product;

a product name extraction unit which extracts a product name of the first product from the product information storage unit responding to the first inquiry corresponding to only the first product;

a search condition setting unit which sets a search condition for a second product using the extracted product name and a keyword indicating a category different from a category of the specific product, wherein the keyword is based on the first inquiry about the first product;

a product information search unit which searches for product information associated with only the second product satisfying the set search condition, and extracts product information of the second product from the product information storage unit;

a product information output unit which outputs the extracted product information about only the second product satisfying the set search condition;

a text forwarding unit which forwards the first inquiry for the seller of the first product to a seller's terminal of a seller of the second product related to the extracted product information;

an answer text input unit which receives an answer text to the first inquiry, from the seller's terminal of the seller of the second product; and an answer text forwarding unit which transmits the received answer text to the buyer's terminal.

* * * * *